US008936433B2

(12) United States Patent
Liu et al.

(10) Patent No.: US 8,936,433 B2
(45) Date of Patent: Jan. 20, 2015

(54) ANTI-RELIEF FAN FRAME BODY STRUCTURE

(75) Inventors: Wen-Hao Liu, New Taipei (TW); Guan-Chen Yin, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 505 days.

(21) Appl. No.: 13/296,492

(22) Filed: Nov. 15, 2011

(65) Prior Publication Data

US 2013/0121822 A1 May 16, 2013

(51) Int. Cl.

| | |
|---|---|
| ***F04D 29/16*** | (2006.01) |
| ***F04D 25/06*** | (2006.01) |
| ***F04D 29/32*** | (2006.01) |
| ***F04D 29/54*** | (2006.01) |

(52) U.S. Cl.

CPC ..... *F04D 25/0613* (2013.01); *F04D 29/164* (2013.01); *F04D 29/326* (2013.01); *F04D 29/542* (2013.01)

USPC ..... 415/211.2

(58) Field of Classification Search

USPC ..... 415/182.1, 185, 186, 208.1, 208.2, 415/208.3, 211.2, 213.1, 227, 228, 168.2, 415/170.1, 171.1, 173.5, 174.5, 175

See application file for complete search history.

(56) References Cited

U.S. PATENT DOCUMENTS

| | | | | |
|---|---|---|---|---|
| 3,460,843 | A * | 8/1969 | Jaeger | 277/411 |
| 5,066,194 | A * | 11/1991 | Amr et al. | 415/223 |
| 5,443,363 | A * | 8/1995 | Cho | 415/211.1 |
| 5,489,186 | A * | 2/1996 | Yapp et al. | 415/58.7 |
| 6,183,221 | B1 * | 2/2001 | Hsieh | 417/423.12 |
| 6,599,088 | B2 * | 7/2003 | Stagg | 415/173.6 |
| 7,080,973 | B2 * | 7/2006 | Tung et al. | 416/174 |
| 7,478,993 | B2 * | 1/2009 | Hong et al. | 415/211.2 |
| 7,588,419 | B2 * | 9/2009 | Hong et al. | 415/211.2 |
| 2006/0067814 | A1 * | 3/2006 | Wang et al. | 415/170.1 |
| 2011/0027075 | A1 * | 2/2011 | Nogami et al. | 415/182.1 |

* cited by examiner

*Primary Examiner* — Edward Look
*Assistant Examiner* — Eldon Brockman

(57) ABSTRACT

An anti-relief fan frame body structure includes a frame body and multiple anti-relief sections. The frame body has a receiving space and a shaft seat received in the receiving space. The frame body further has multiple flow guide members extending from a circumference of shaft seat to an inner circumference of the frame body to connect with the inner circumference of the frame body. The anti-relief sections are disposed on the inner circumference of the frame body between the flow guide members to increase the performance of the fan.

10 Claims, 7 Drawing Sheets

23 233 234

ANTI-RELIEF FAN FRAME BODY STRUCTURE

BACKGROUND OF THE INVENTION

1. Field of the Invention

The present invention relates generally to a fan frame body structure, and more particularly to an anti-relief fan frame body structure, which can increase the performance of the fan.

2. Description of the Related Art

Following the rapid development of high-performance, high-frequency, high-speed and slimmed electronic products, the electronic products generate more and more heat in operation. As a result, the electronic products are likely to operate unstably. This will affect reliability of the products and shorten lifetime of the products. Therefore, it has become a critical issue how to dissipate the heat generated by the electronic products. In general, a cooling fan is often used as a heat dissipation for dissipating the heat generated by the electronic products When a conventional cooling fan operates, eddy is often formed between the blades of the fan. The eddy will cause deterioration of the performance (such as air volume) of the fan. To solve this problem, an annular fan has been developed.

Please refer to FIGS. 1A and 1B. The conventional annular fan 1 includes a frame body 10 and a fan impeller 11. The frame body 10 has a wind outlet side 101, a wind inlet side 102 opposite to the wind outlet side 101 and a bearing cup 104.

The wind outlet side 101 and the wind inlet side 102 together define a receiving space 12 for receiving the fan impeller 11 therein. The bearing cup 104 is positioned at a center of the receiving space 12. The fan impeller 11 is rotatably disposed in the bearing cup 104.

The fan impeller 11 has a hub 111 and multiple blades 112 annularly arranged along outer circumference of the hub 111. Each blade 112 has a free end. An annular body 14 is connected to the free ends of the blades 112. A gap 15 is defined between the annular body 14 and inner circumference of the frame body 10. When the fan operates, the annular body 14 is able to reduce the eddy between the blades so as to increase the performance of the fan.

In the conventional annular fan 1, the annular body 14 serves to overcome the problem of generation of the eddy. However, the annular body 14 leads to another problem. In operation of the annular fan 1, the fluid is guided in from the wind inlet side 102 and then guided out from wind outlet side 101. At this time, a negative pressure is created on the wind outlet side 101. Accordingly, part of the guided out fluid 17 will flow back through the gap 15 to interfere with the guided in fluid to produce turbulence. As a result, the fluid can hardly flow smoothly. This will lead to deterioration of the performance of the fan and make great noise.

According to the above, the conventional fan has the following shortcomings:

1. The performance of the fan is deteriorated.
2. The fan will make great noise in operation.

SUMMARY OF THE INVENTION

A primary object of the present invention is to provide an anti-relief fan frame body structure, which can increase the performance of the fan.

A further object of the present invention is to provide the above anti-relief fan frame body structure, which can effectively increase air volume of the fan without changing any dynamic blade or static blade of the fan.

To achieve the above and other objects, the anti-relief fan frame body structure of the present invention includes a frame body and multiple anti-relief sections. The frame body has a receiving space and a shaft seat received in the receiving space. The frame body further has multiple flow guide members extending from a circumference of shaft seat to an inner circumference of the frame body to connect with the inner circumference of the frame body. The anti-relief sections are disposed on the inner circumference of the frame body between the flow guide members to increase the performance of the fan.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
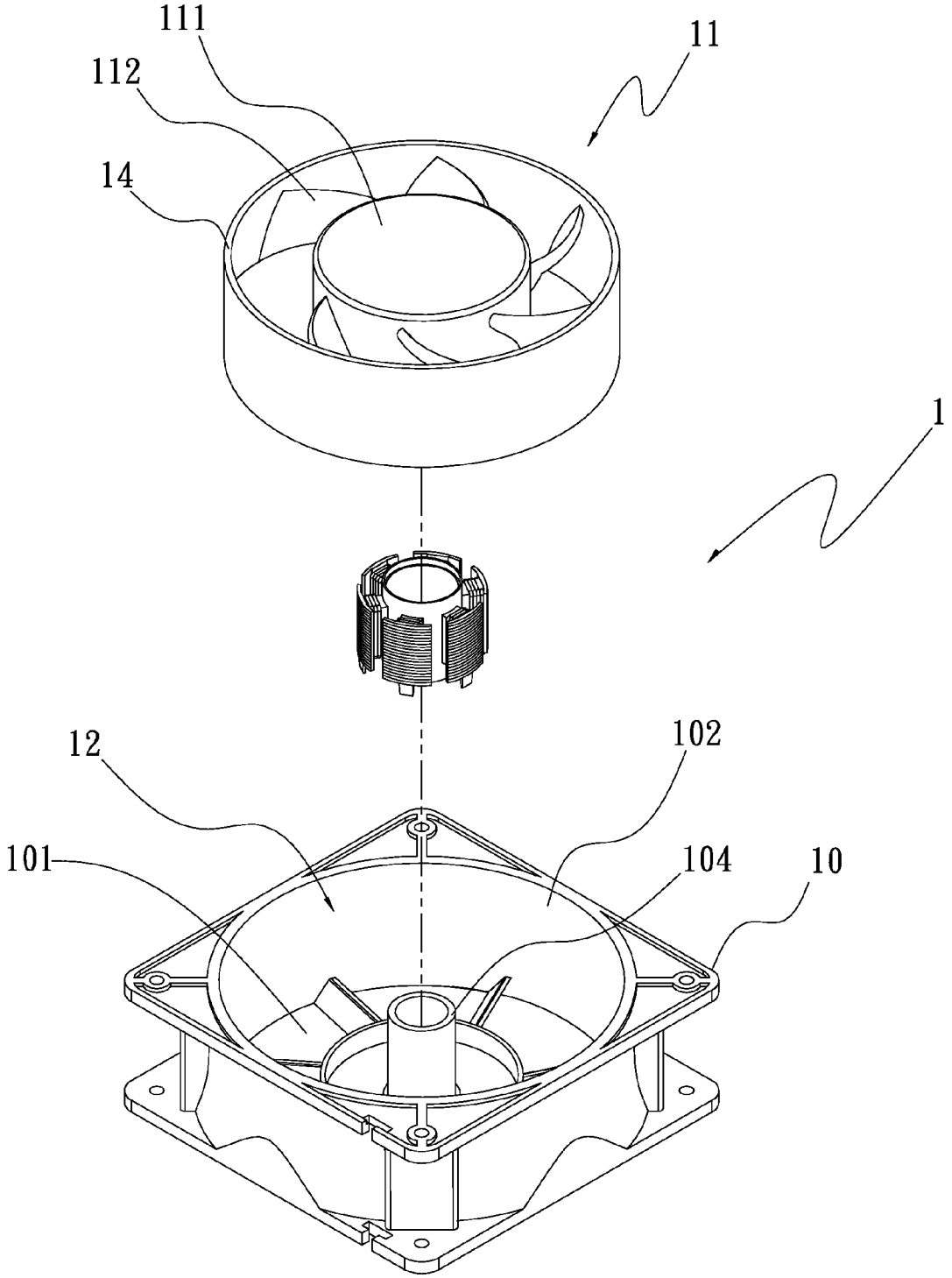
Fig. 1A(PRIOR ART)
FIG. 1A is a perspective exploded view of a conventional fan.
Figure 1B:
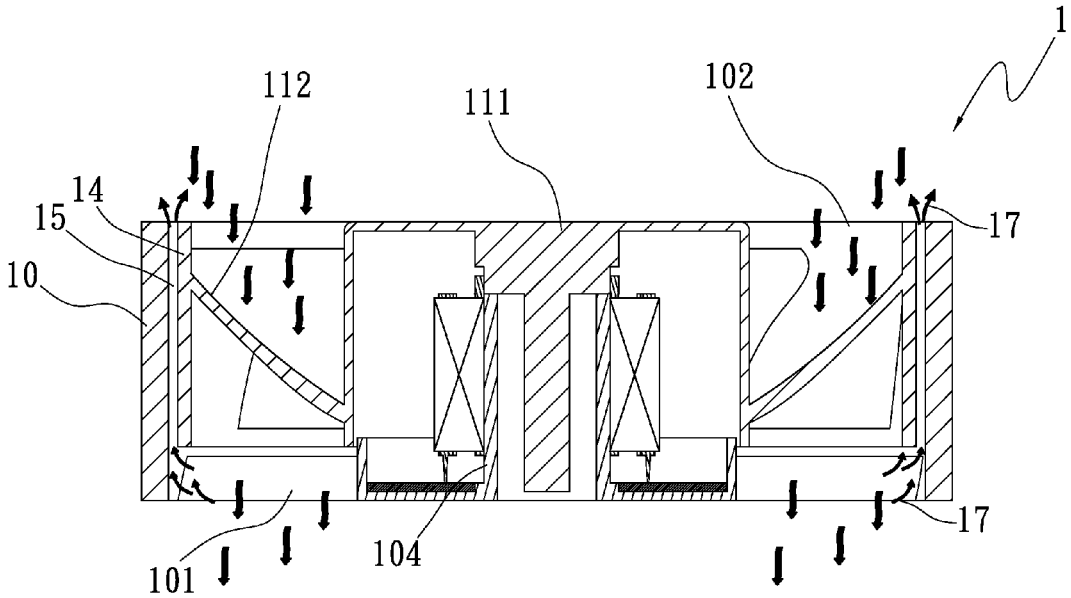
Fig. 1B(PRIOR ART)
FIG. 1B is a sectional assembled view of the conventional fan.
Figure 2:
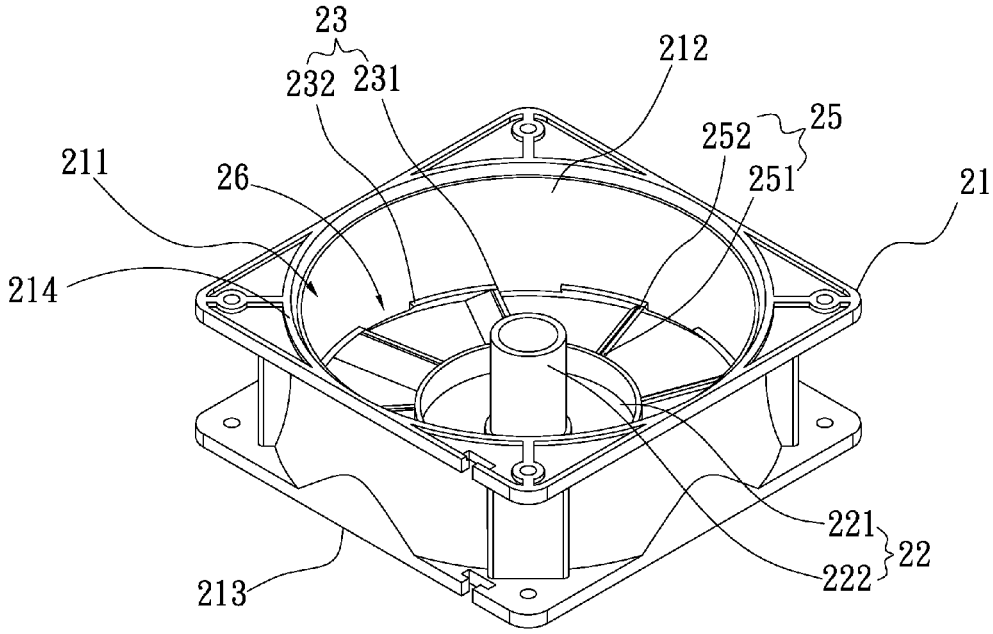
FIG. 2 is a perspective view of a first embodiment of the present invention.
Figure 3:
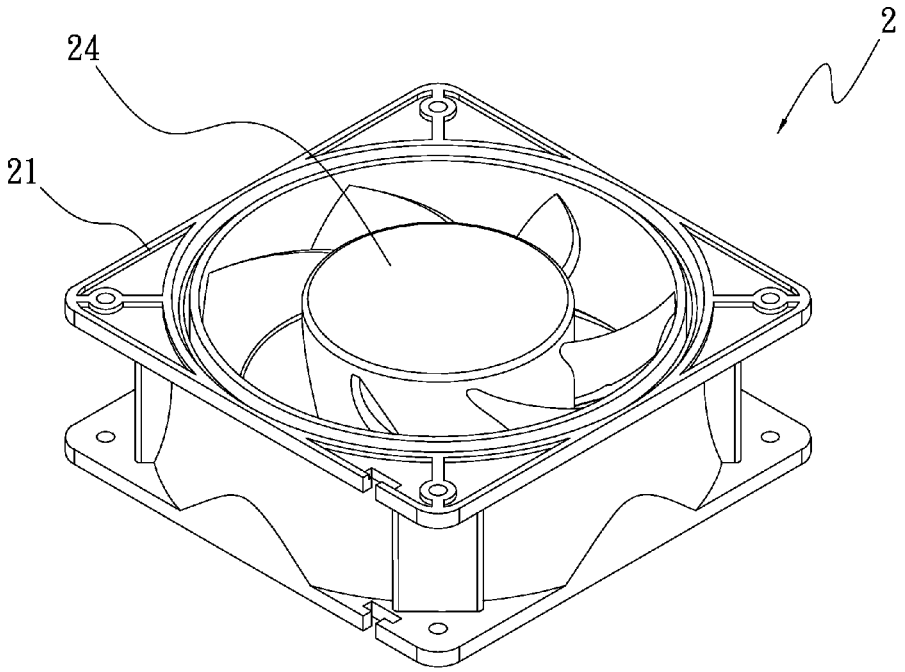
FIG. 3 is a perspective assembled view of the fan of the present invention.
Figure 4:
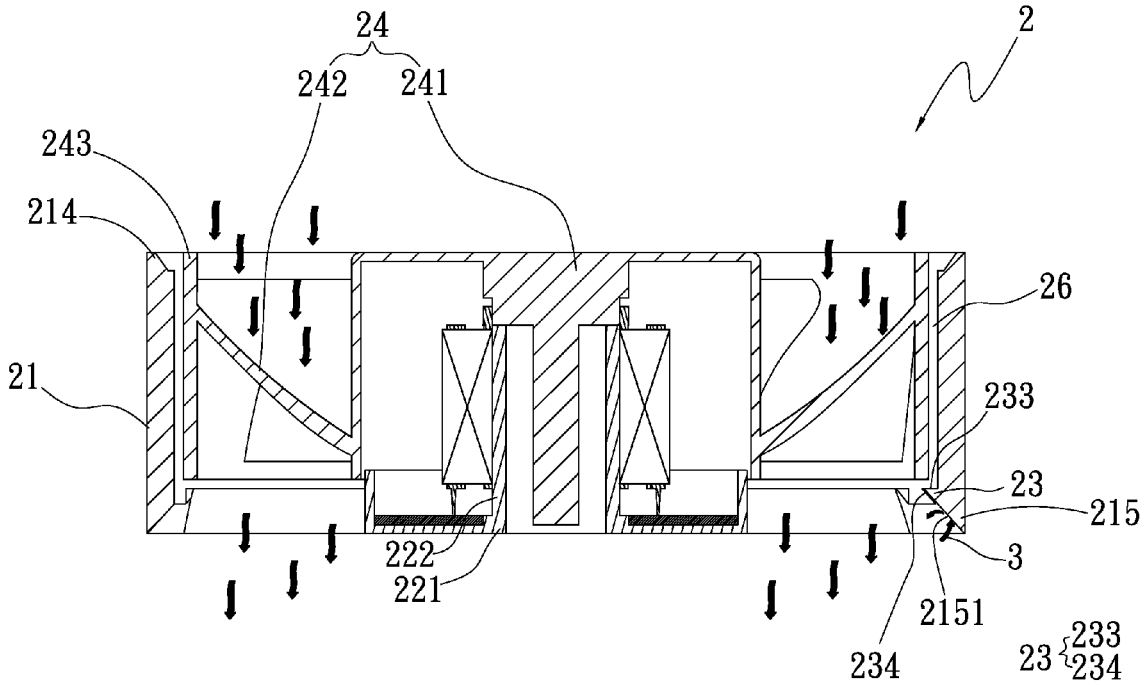
FIG. 4 is a sectional assembled view of the first embodiment of the fan of the present invention.

Please refer to FIGS. 2, 3 and 4. FIG. 2 is a perspective view of a first embodiment of the present invention. FIG. 3 is a perspective assembled view of the fan of the present invention. FIG. 4 is a sectional assembled view of the first embodiment of the fan of the present invention. According to the first embodiment, the anti-relief fan frame body structure of the present invention includes a frame body 21 and multiple anti-relief sections 23. The frame body 21 has a receiving space 211, a top portion 214, a bottom portion 215 and a shaft seat 22. The receiving space 211 has a wind inlet side 212 and a wind outlet side 213 opposite to the wind inlet side 212. The top portion 214 and the bottom portion 215 are disposed in adjacency to the wind inlet side 212 and the wind outlet side 213, respectively. The bottom portion 215 comprises a stop backflow inclined surface 2151 which is upward obliquely extending from an edge of the bottom portion 215 of the frame body 21 toward the receiving space 211 below a plurality of blades 242. The wind inlet side 212 and the wind outlet side 213 together define the receiving space 211 for receiving a fan impeller 24 therein. The fan impeller 24 has a hub 241, an annularity portion 243 and multiple blades 242 annularly arranged along outer circumference of the hub 241. First ends of the blades 242 facing an inner circumference of the frame body 21 are not corresponding to the anti-relief sections 23. The annularity portion 243 is positioned at the first ends of the blades 242 facing the inner circumference of the frame body 21 and away from the hub 241. Furthermore, the stop backflow inclined surface 2151 upward obliquely extending from the edge of the bottom portion 215 of the frame body 21 toward the receiving space 211 is below the annularity portion 243. The annularity portion 243 and the corresponding inner circumference of the frame body 21 together define a gap 26. In operation of the fan impeller 24, the external fluid is guided in from the wind inlet side 212 and pressurized and then guided out from the wind outlet side 213.

The shaft seat 22 is disposed in the receiving space 211 in adjacency to the wind outlet side 213. The shaft seat 22 has a base section 221 and a bearing cup 222 axially extending from the base section 221. The fan impeller 24 is rotatably fitted in the bearing cup 222 to form a fan 2. The frame body 21 further has multiple flow guide members 25. In this embodiment, the flow guide members 25 are, but not limited to, fan blades for illustration purposes only. Alternatively, the flow guide members 25 can be ribs.

The flow guide members 25 are connected between the shaft seat 22 and inner circumference of the frame body 21. The flow guide members 25 extend from a circumference of the base section 221 to the inner circumference of the frame body 21. Each flow guide member 25 has a first connection end 251 and a second connection end 252. The first connection end 251 is fixedly connected with the circumference of the base section 221, while the second connection end 252 is fixedly connected with the inner circumference of the frame body 21.

Figure 5:
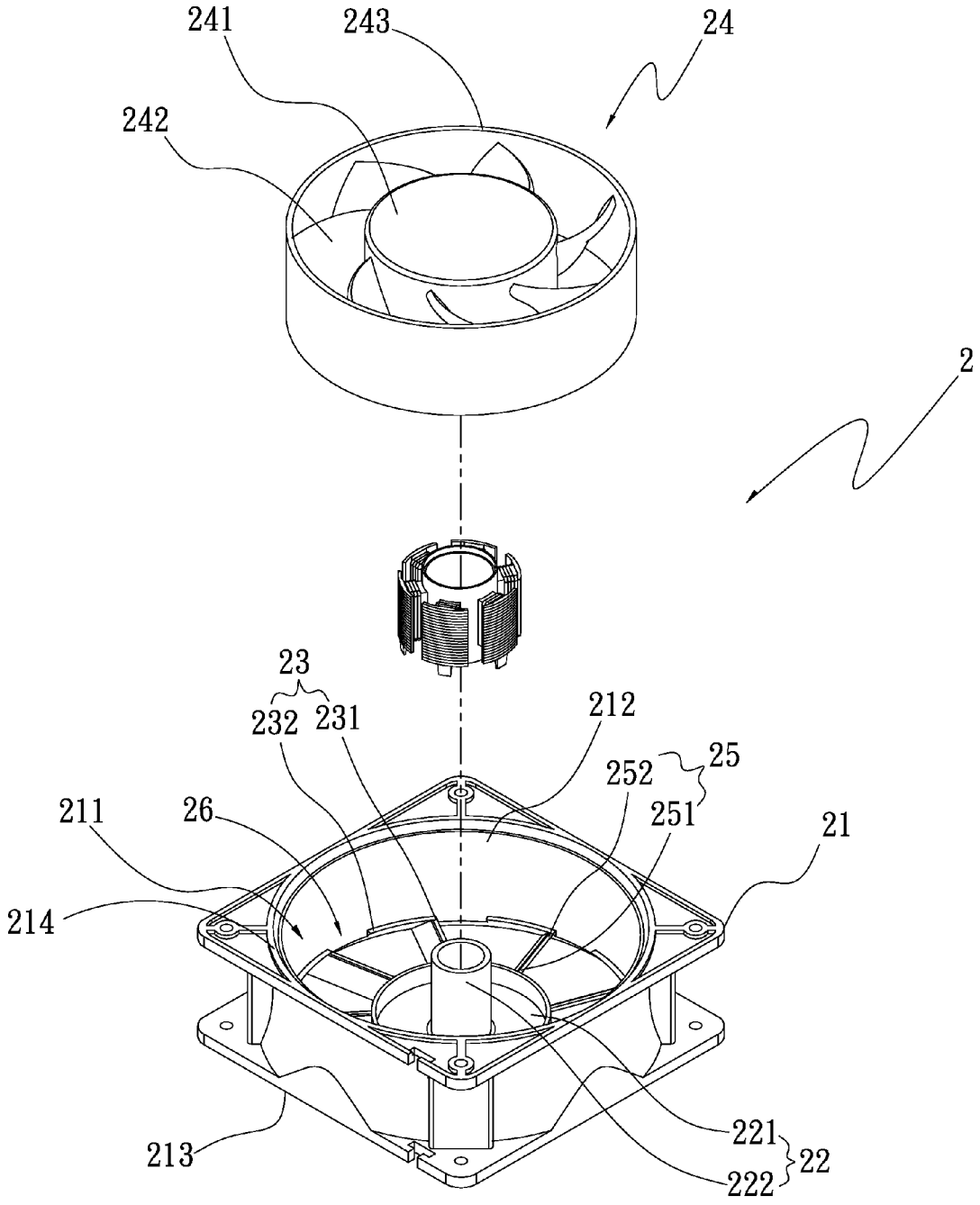
FIG. 5 is a perspective exploded view of the first embodiment of the fan of the present invention.

Please further refer to FIGS. 4 and 5. The anti-relief sections 23 are disposed on the inner circumference of the frame body 21 between the flow guide members 25 and in adjacency to the wind outlet side 213. Each anti-relief section 23 has a first end 231, and a second end 232, a flat surface 233 and a slant surface 234. The first end 231 is integrally connected with the second connection end 252 of the adjacent flow guide member 25. The second end 232 and the second connection end 252 of another opposite flow guide member 25 define therebetween an opening 26. The slant surface 234 is flush and connected with the stop backflow inclined surface 2151. The flat surface 233 of the anti-relief section 23 is below the blades 242, namely, the flat surface 233 is facing the annularity portion 243 and the gap 26. The width of the flat surface 233 of the anti-relief section 23 is larger or equal to that of the gap 26.

In this embodiment, the anti-relief sections 23 are, but not limited to, integrally formed on the inner circumference of the frame body 21 by injection molding between the flow guide members 25 for illustration purposes only. In practice, alternatively, the anti-relief sections 23 can be separately formed members and connected to the inner circumference of the frame body 21 between the flow guide members 25 by means of adhesion or insertion. The anti-relief sections 23, the flow guide members 25 and the frame body 21 together form an integral body.

Moreover, in practice, the anti-relief sections 23 can be designed with different configurations and sizes in accordance with the requirements in air volume anti-relief effect.

When the fan impeller 24 of the fan 2 operates, the external fluid is guided in from the wind inlet side 212 and pressurized and then guided out of the receiving space 211 from the wind outlet side 213 through the flow guide members 25. At this time, a backflow of fluid 3 is produced on the wind outlet side 213. The anti-relief sections 23 serve to stop the backflow of fluid 3 from flowing back to the wind inlet side 212 and guide out the backflow of fluid 3 from the wind outlet side 213. Therefore, the backflow of fluid 3 will not interfere with the fluid guided in from the wind inlet side 212 so that the fluid can be smoothly guided into the fan 2 and guide out of the fan 2. Accordingly, the anti-relief sections 23 can achieve an anti-relief effect to enhance the performance of the fan.

Figure 9:
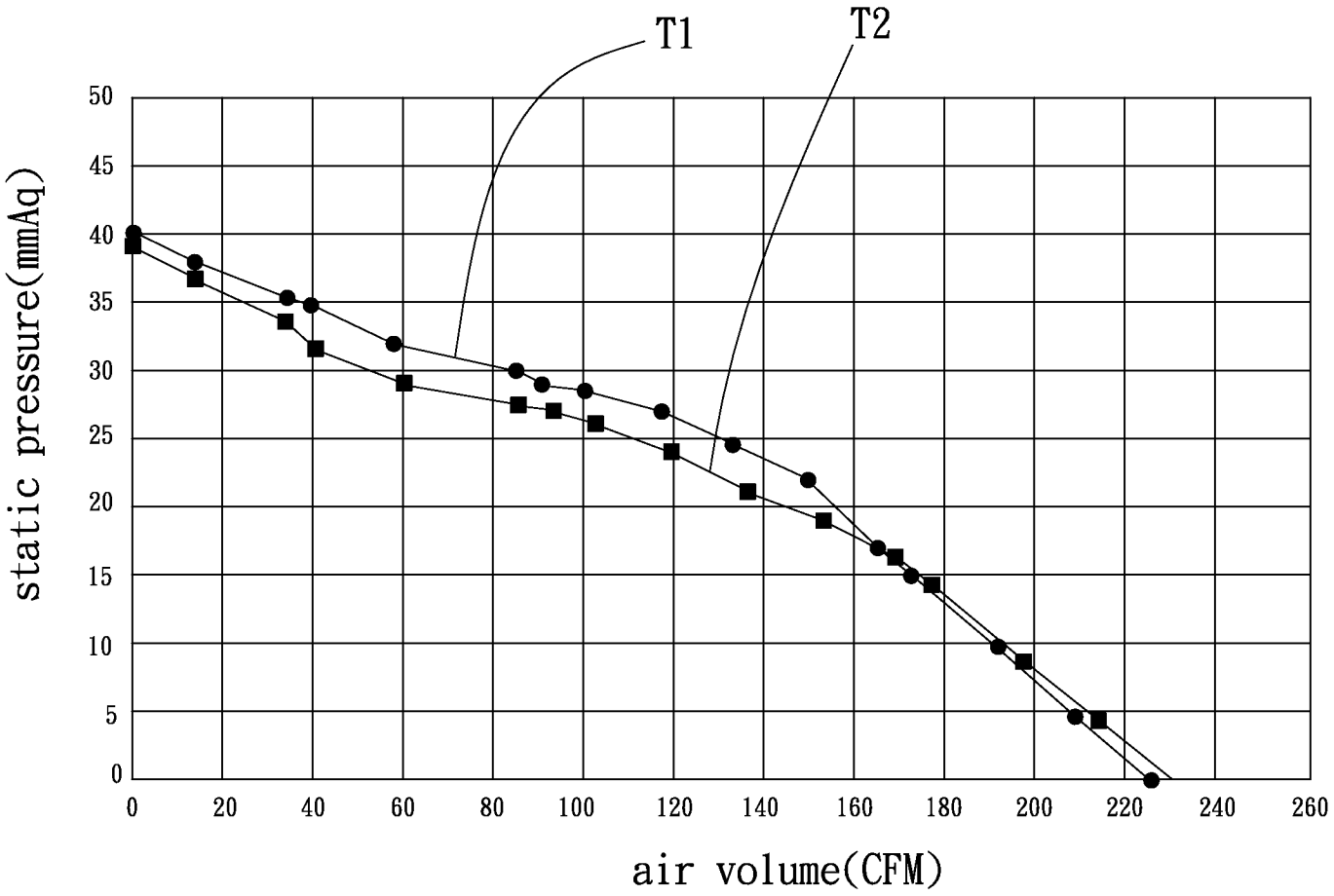
FIG. 9 is a comparison diagram between performance curve of the present invention and performance curve of the conventional fan.

Please now refer to FIGS. 4 and 9. FIG. 9 is a comparison diagram between air volume curve (also referred to as P (static pressure)-Q (air quantity) curve) of the present invention and air volume curve of the conventional fan. It can be seen from the diagram that the P-Q curve T1 of the present invention with the anti-relief sections 23 is apparently higher than the P-Q curve T2 of the conventional fan. That is, the air volume of the present invention is much higher than that of the conventional fan. Therefore, the air volume is effectively increased without changing any dynamic blade or static blade of the fan.

Figure 6:
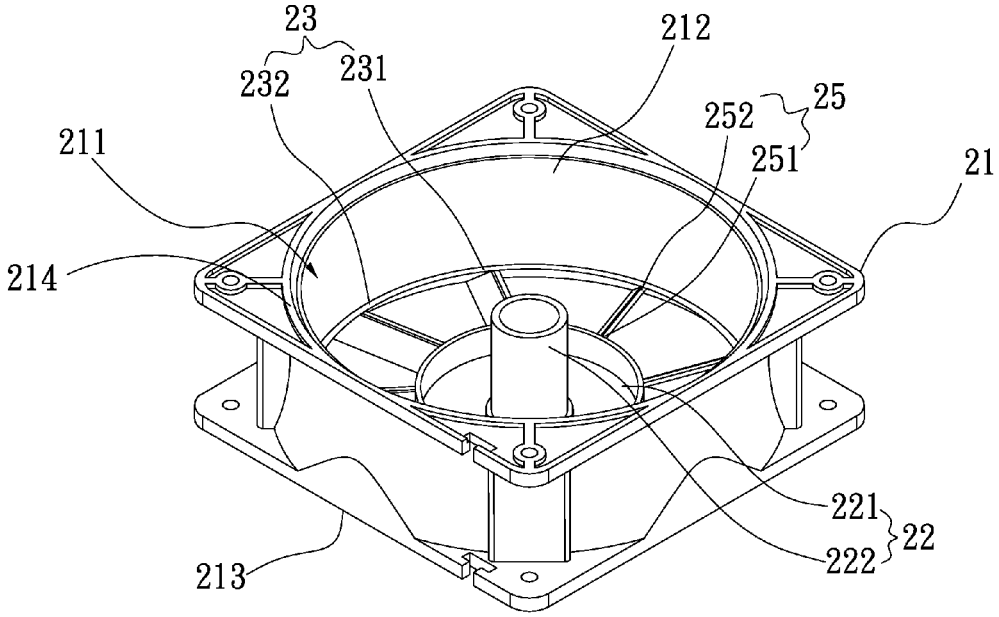
FIG. 6 is a perspective view of a second embodiment of the present invention.
Figure 7:
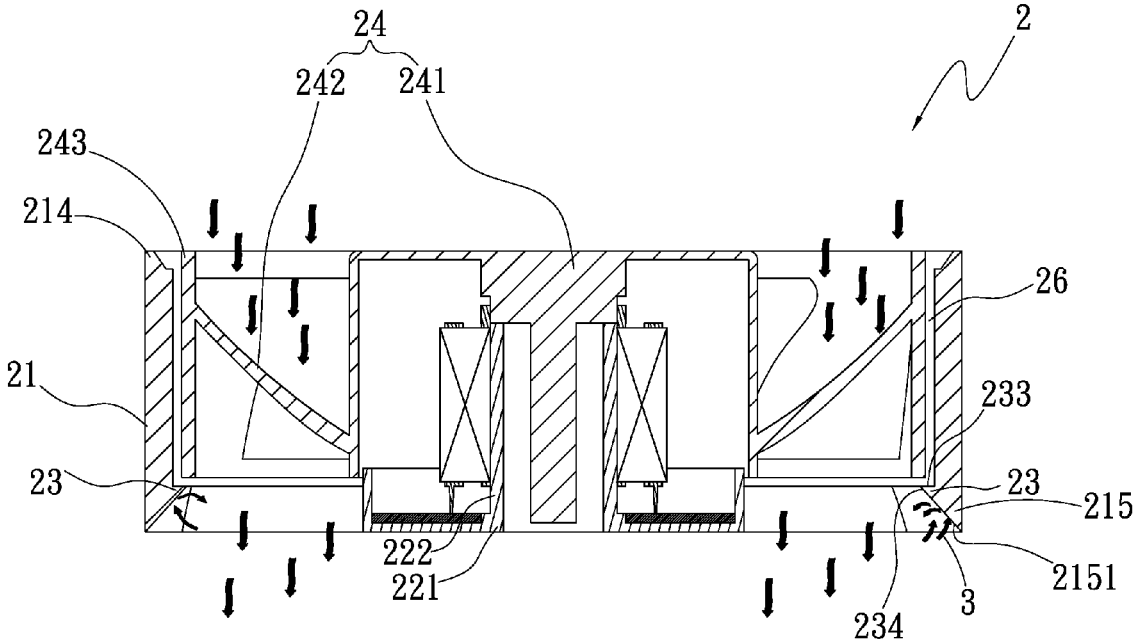
FIG. 7 is a sectional assembled view of the second embodiment of the fan of the present invention.
Figure 8:
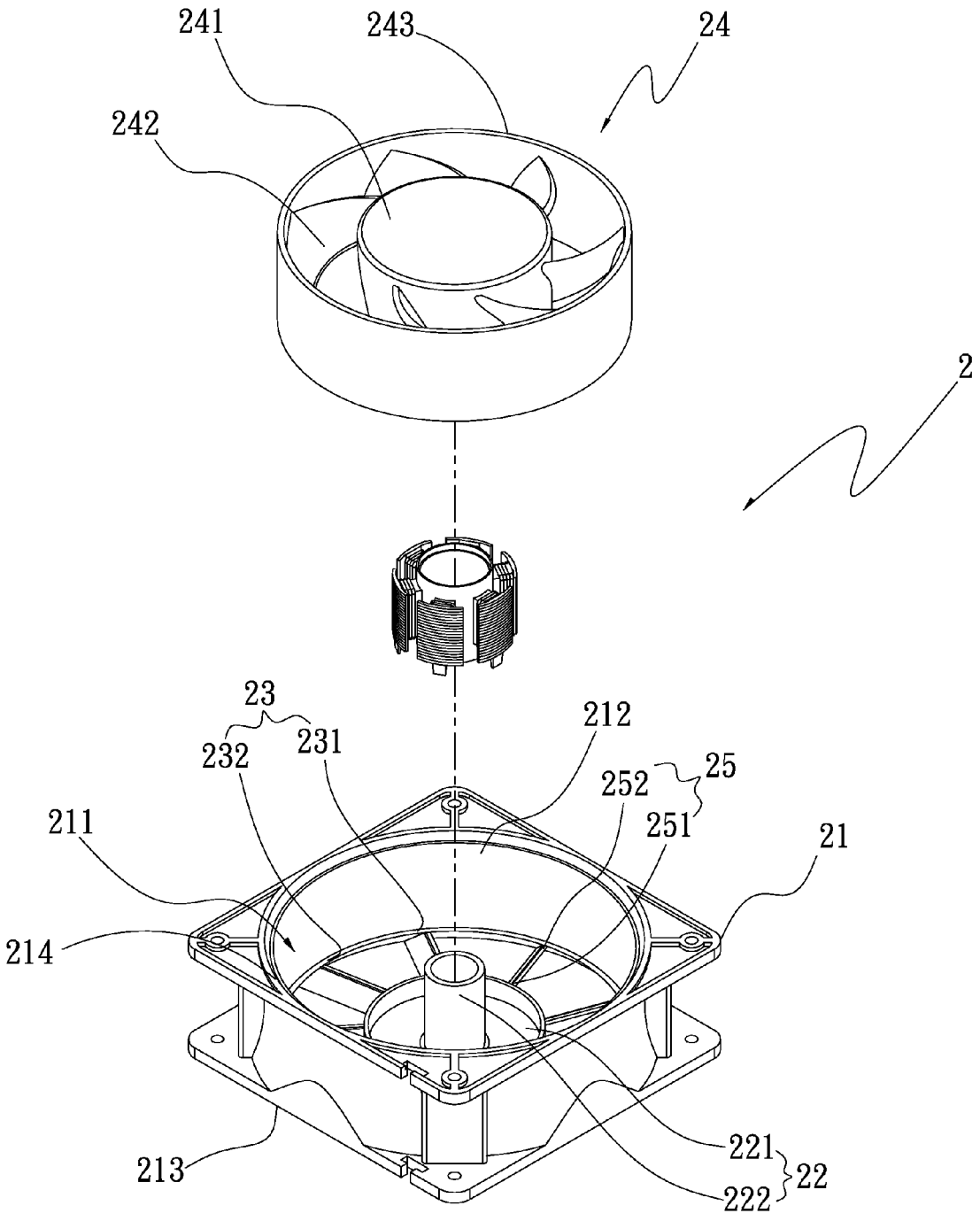
FIG. 8 is a perspective exploded view of the second embodiment of the fan of the present invention.

Please now refer to FIGS. 3, 6, 7 and 8. FIG. 6 is a perspective view of a second embodiment of the present invention. FIG. 7 is a sectional assembled view of the second embodiment of the fan of the present invention. FIG. 8 is a perspective exploded view of the second embodiment of the fan of the present invention. The second embodiment is substantially identical to the first embodiment in structure and connection relationship and thus will not be repeatedly described hereinafter. The second embodiment is different from the first embodiment in that the first and second ends 231, 232 of one anti-relief section 23 are respectively connected with the second connection ends 252 of each two adjacent flow guide members 25. That is, the first end 231 of the anti-relief section 23 is connected with the second connection end 252 of one flow guide member 25, while the second end 232 of the anti-relief section 23 is connected with the second connection end 252 of another flow guide member 25. Accordingly, the anti-relief sections 23 are integrally connected with the second connection ends 252 of the flow guide members 25 to form an annular body.

The annular body composed of the anti-relief sections 23 serves to stop the backflow of fluid 3 from flowing back to the wind inlet side 212 so as to achieve an excellent anti-relief effect to effectively enhance the performance of the fan.

In conclusion, in comparison with the conventional fan, the present invention has the following advantages:

1. The present invention is able to provide anti-relief effect.
2. The present invention is able to increase the performance of the fan.

The above embodiments are only used to illustrate the present invention, not intended to limit the scope thereof. It is understood that many changes and modifications of the above embodiments can be made without departing from the spirit of the present invention. The scope of the present invention is limited only by the appended claims.

What is claimed is:

1. An anti-relief fan frame body structure comprising:

a frame body having a receiving space, a top portion, a bottom portion and a shaft seat received in the receiving space, the receiving space having a wind inlet side and a wind outlet side opposite to the wind inlet side, the wind inlet side and the wind outlet side together defining the receiving space, the top portion and the bottom portion being in adjacency to the wind inlet side and the wind outlet side, respectively, the bottom portion comprising a stop backflow inclined surface, the shaft seat being in adjacency to the wind outlet side and having a base section and a bearing cup, the bearing cup being axially extending from the base section for rotatably fitting with a fan impeller with a plurality blades, the frame body further having multiple flow guide members extending from a circumference of shaft seat to an inner circumference of the frame body to connect with the inner circumference of the frame body; and multiple anti-relief sections disposed on the inner circumference of the frame body between the flow guide members and comprising a flat surface and a slant surface, the flat surface below the blades of the fan impeller, the slant surface being connected with the stop backflow inclined surface; and wherein the stop backflow inclined surface is upward obliquely extending from an edge of the bottom portion of the frame body toward the receiving space below the blades; and wherein ends of the blades facing the inner circumference of the frame body do not correspond to the anti-relief sections, and the anti-relief sections are positioned under the blades.

2. The anti-relief fan frame body structure as claimed in claim 1, wherein the flow guide members are connected between the shaft seat and the inner circumference of the frame body, each flow guide member having a first connection end and a second connection end outward extending from the first connection end, the first connection end being fixedly connected with a circumference of the base section, while the second connection end being fixedly connected with the inner circumference of the frame body.

3. The anti-relief fan frame body structure as claimed in claim 2, wherein each anti-relief section has a first end and a second end, the first end being connected with the second connection end of an adjacent flow guide member, the second end and the second connection end of another opposite flow guide member defining therebetween an opening.

4. The anti-relief fan frame body structure as claimed in claim 1, wherein the anti-relief sections are integrally formed on the inner circumference of the frame body by injection molding between the flow guide members.

5. The anti-relief fan frame body structure as claimed in claim 2, wherein each anti-relief section has a first end and a second end, the first and second ends of one anti-relief section being respectively connected with the second connection ends of each two adjacent flow guide members to form an annular body.

6. The anti-relief fan frame body structure as claimed in claim 1, wherein the flow guide members are fan blades or ribs.

7. The anti-relief fan frame body structure as claimed in claim 1, wherein the anti-relief sections are connected to the inner circumference of the frame body between the flow guide members by means of adhesion or insertion.

8. The anti-relief fan frame body as claimed in claim 1, wherein the fan impeller further comprises a hub and an annularity portion, the plurality of blades being annularly arranged along an outer circumference of the hub, the annularity portion being positioned at the first ends of the blades away from the hub, the annularity portion and the inner circumference of the frame body together defining a gap which having a width smaller than or equal to that of the flat surface of the anti-relief section.

9. The anti-relief fan frame body as claimed in claim 8, wherein the stop backflow inclined surface is upward obliquely extending from an edge of the bottom portion of the frame body toward the receiving space below the annularity portion of the fan impeller, and the flat surface of the anti-relief section is facing the annularity portion and the gap.

10. The anti-relief fan frame body structure as claimed in claim 9, the anti-relief section comprises a flat surface and a slant surface, the flat surface being corresponding to the annularity portion and the gap, and the slant surface being flush and connected with the stop backflow inclined surface.

* * * * *